US012448742B1

(12) United States Patent
Fernandez Lillo

(10) Patent No.: US 12,448,742 B1
(45) Date of Patent: Oct. 21, 2025

(54) OVERHANG STRUCTURE AND CONSTRUCTION METHOD FOR A BRIDGE OVERHANG

(71) Applicant: Webber, LLC, The Woodlands, TX (US)

(72) Inventor: Carlos Fernandez Lillo, Dallas, TX (US)

(73) Assignee: Webber, LLC, The Woodlands, TX (US)

( * ) Notice: Subject to any disclaimer, the term of this patent is extended or adjusted under 35 U.S.C. 154(b) by 0 days.

(21) Appl. No.: 19/062,112

(22) Filed: Feb. 25, 2025

(51) Int. Cl.
*E01D 21/10* (2006.01)

(52) U.S. Cl.
CPC ..... *E01D 21/10* (2013.01)

(58) Field of Classification Search
CPC ..... E04G 11/365; E01D 21/10; E01D 21/00; E01D 21/105
See application file for complete search history.

(56) References Cited

U.S. PATENT DOCUMENTS 2,921,354 A * 1/1960 Pankey ..... B28B 7/0088 52/294
3,755,983 A * 9/1973 Beckham ..... E04G 17/18 249/19
5,218,795 A * 6/1993 Horstketter ..... E04B 5/046 52/126.5
5,471,811 A 12/1995 House
6,115,979 A * 9/2000 Horstketter ..... E04B 5/38 52/459
6,715,729 B2 * 4/2004 Hambelton ..... E04G 13/066 249/23
9,783,982 B2 * 10/2017 Dinmore ..... E04B 5/32
10,840,682 B2 * 11/2020 Tipton ..... H02G 3/0468
11,761,161 B2 * 9/2023 Fulcher ..... E02D 29/02 405/284
11,913,180 B1 * 2/2024 Fernandez Lillo ..... E01D 19/02
11,982,059 B1 * 5/2024 DelSignore ..... E01D 22/00
2001/0037614 A1 * 11/2001 Hambelton ..... E01D 21/00 52/126.1
2010/0243857 A1 * 9/2010 Grimaldo ..... E04G 17/18 249/19
2018/0030745 A1 2/2018 Dinmore et al.
2018/0298601 A1 * 10/2018 Brodowski ..... E04B 5/40
2020/0283971 A1 * 9/2020 Roberts ..... E04G 13/066
2020/0407967 A1 * 12/2020 Dinmore ..... E04G 11/085

* cited by examiner

*Primary Examiner* — Abigail A Risic
(74) *Attorney, Agent, or Firm* — Defillo & Associates, Inc.; Evelyn A. Defillo

(57) ABSTRACT

Overhang structure for bridges including a horizontal section (41) and an upwards section (42). The horizontal section (41) has at least one integral horizontal profile (7) at its free end. It may also include a strip made of a malleable material on the lower side of the horizontal section (41). The construction method includes the steps of: placing a set of rods near an outmost edge of an outmost beam; placing the beam on its supports; placing a set of overhang structures on the rods, so the profiles are close to the rods; and affixing the structures to the beams with a retainer in each rod.

4 Claims, 1 Drawing Sheet

OVERHANG STRUCTURE AND CONSTRUCTION METHOD FOR A BRIDGE OVERHANG

OBJECT OF THE INVENTION

A construction methodology specially designed for the construction of overhangs in bridges is proposed. It is based on forms placed in the outside of the outmost support beam, where these forms are supported by rods affixed to the beam. The structure used in the overhang is also proposed.

STATE OF THE ART

It is known from US2018030745 a method for constructing a cantilevered portion of a bridge, at the longitudinal edges. This method involves placing an L-shaped formwork and a set of braces and ties that work under tension. This solution is reasonably effective but has several drawbacks. For instance, the placement of the braces and ties requires a lot of labor, with the consequent risk for the personnel located at the top of the bridge. In addition, the presence of braces and ties makes it difficult for workers to pass through, increasing said risk.

U.S. Pat. No. 5,471,811 offers a way of making the final barrier in which it comprises a reinforcement that overlaps with the structure itself, for the introduction of concrete and a rod along the barrier. This solution does not adequately support the barrier until the concrete sets, so it is not as safe as the current invention.

SUMMARY OF THE INVENTION

Due to all this, a construction method for a bridge overhang is proposed that allows for the easy, fast, and safe construction of bridges overhangs.

The invention is an overhang structure, for a bridge edge, comprising an horizontal section and an upwards section. The horizontal section has at least one horizontal profile at its free end, integral to the structure. That is, there is no possible movement between the profiles and the horizontal section of the structure.

This horizontal section may comprise a strip of malleable material on its lower side.

In a preferred embodiment, the profiles are set in pairs with a slot between the profiles of each pair. A rod in the supporting beam is designed to pass through the slot when affixing the structure to the beam.

The construction method for a bridge overhang that uses those structures may be as follow. This method is applied on bridges with at least one beam, and comprises the steps of:

- Placing a set of rods near an outmost edge of an outmost beam. It can be either edge of the bridge, or both.
- Placing said beam on its supports, usually pillars or abutments.
- Placing a set of structures as defined on the rods, so the profiles are close to the rods.
- Affixing the structures to the beams with a retainer in each rod.

Other variants and embodiments will be appreciated in the remainder of the specification.

BRIEF DESCRIPTION OF THE DRAWINGS

To complement the description below and in order to provide a better understanding of the invention, a set of drawings is attached as an integral part of said description according to a preferred example of its practical embodiment. In those drawings, with an illustrative and non-limiting nature, the following has been represented.

DETAILED DESCRIPTION OF THE INVENTION

Figure 1:
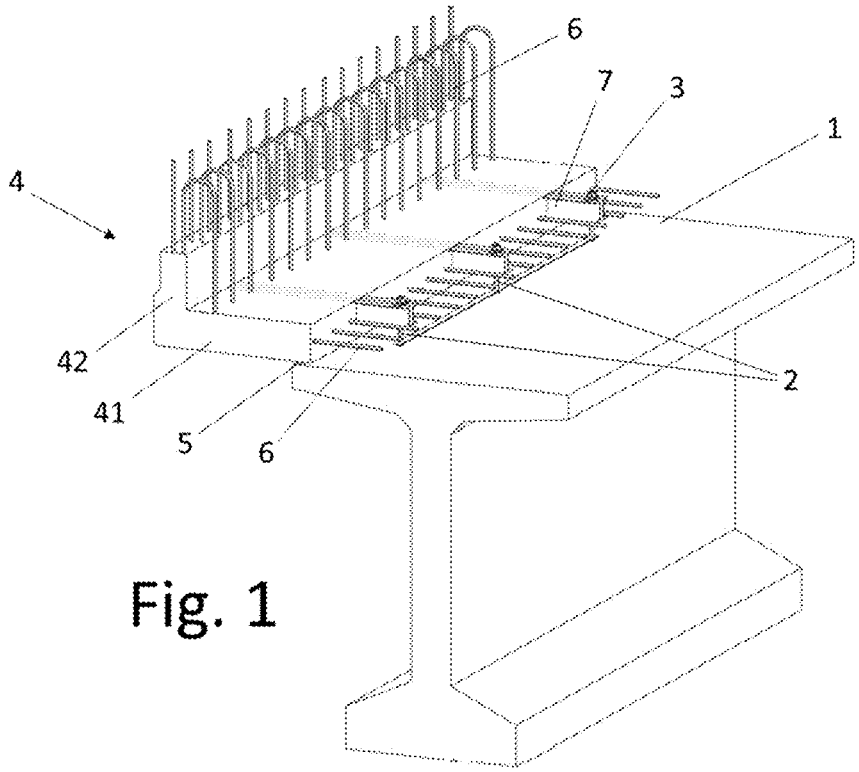
FIG. 1 is a perspective schematic view of an embodiment of the upper surface of the beam with several structures.
Figure 2:
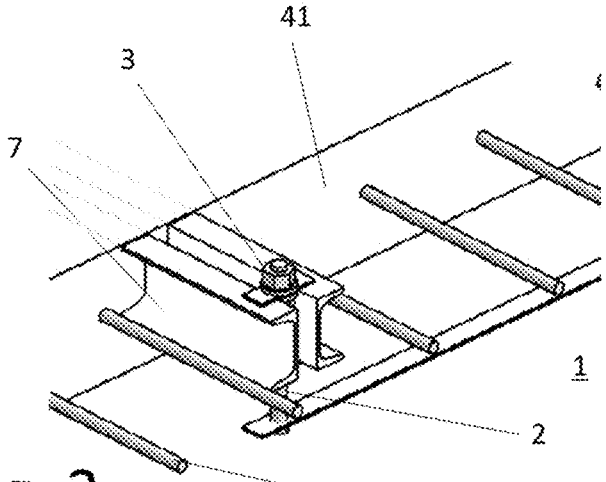
FIG. 2 is a close up of the rods and profiles in the embodiment of FIG. 1.

FIG. 1 shows a schematic of a bridge where the invention is applied. This figure shows the edge of a beam (1) on which a set of rods (2), generally vertical, have been placed, forming a line parallel to the edge of the beam (1). Generally, these rods (2) are threaded, especially at the free end. On them a retainer (3) is attached, which preferably works by threading, although it can be a clamp if its mechanical resistance is sufficient. The retainer (3) can preferably be placed at variable height at the free end of the stem (2).

Usually, those beams (1) are made of steel or concrete. The rods (2) may then be welded, embedded in the beam (1) depending on the material of the beam (1).

Attached to the rods (2) is an "L" shaped structure (4), generally made of reinforced concrete. The structure (4) has a horizontal section (41) and a upwards section (42), generally at right angles. In order to make better use of its advantages, the structure (4) is partially cantilevered on the edge of the beam (1), so that it only rests on the beam (1) at the free end of the horizontal section (41), the upwards section (42) hanging outside the edge of the beam (1). The contact area of the structure (4) and the beam (1) preferably has a strip (5) of malleable or elastic material, such as silicone, rubber . . . to ensure that this space is adequately sealed. The strip (5) can be integral to the structure (4), to the beam (1) or it can be an independent part.

If the structure (4) is made of reinforced concrete, it might include protruding bars (6) for the placement of new reinforced concrete elements.

The structure (4) has horizontal profiles (7) at the free end of the horizontal section (41). These profiles (7) are fixed to the rods (2) thanks to the retainers (3). Preferably, the profiles (7) are presented in pairs, creating a slot between both profiles (7) for the passage of the rods (2). This allows the positioning of the structure (4) to allow a certain amount of play along the slot. The width of the slot also allows a tolerance in the mutual position. The retainers (3) may incorporate washers, plates or other elements to ensure contact with the profiles (7).

In use, the rods (2) are fixed to the beam (1), by welding (if it is metallic), embedded in the concrete mass . . . . In this second case, the rods (2) may form part of a straight metallic strip from which they emerge every certain distance to protrude from the concrete. This system increases the strength of the connection of the rods (2) to the beam (1).

The method of construction therefore starts with the placement of some rods (2) near an edge of a beam (1) corresponding to an outmost edge of the bridge (the outmost edge of the outmost beam, usually on each side). This placement is preferably carried out in the workshop or on site, but before the beam (1) is raised into position. Subsequently, the beam (1) is placed on its supports. Once correctly positioned, a set of structures (4) as described is placed. The profiles (7) are placed in a position, close to the rods (2), so that the rods (2) can be attached to the profiles (7). The profiles (7) are fixed to the rods (2) with the corresponding retainer (3). Once the structure (4) is thus supported, construction can continue, placing reinforcement bars and other elements of the bridge, since the structures (4) act both as a formwork and as a safety barrier for the workers. It can be appreciated that the only operation carried out by those workers during the claimed method is helping with the positioning of the structure (4) (lifted with a crane) in position and the tightening of the retainers (3). Both tasks are carried out at a distance from the edge of the beam (1).

If the strip (5) is not integral with the structure (4), it may be necessary to place it on the edge of the beam (1), either before raising the beam (1) or before placing the structure (4).

The invention claimed is:

1. An overhang structure for a bridge edge comprising:

a plurality of vertical rods adapted to be attached to a beam, the plurality of vertical rods includes a free end having threads;

an L shaped structure having a horizontal section and a vertical section, a free end of the horizontal section rests on the bridge edge and the vertical section hangs outside the bridge edge;

a plurality of bars protruding from the free end of the horizontal section;

a plurality of profiles horizontally protruding from the free end of the horizontal section;

wherein the plurality of profiles is set in pairs, the pair of profiles is placed close to each other, creating a space between them, wherein the corresponding vertical rod is placed in the space created by each one of the pair of profiles;

a retainer is secured to the free end of the corresponding vertical rod attaching each one of the profiles to each one of the pair of profiles.

2. The overhang structure according to claim 1, wherein the free end of the horizontal section comprises a strip made of a malleable material on a lower side.

3. A method for constructing a bridge overhang, with at least one beam, the method comprising the steps of:

providing an overhang structure including a plurality of vertical rods adapted to be attached to a beam, the plurality of vertical rods includes a free end having threads; an L shaped structure having a horizontal section and a vertical section, a free end of the horizontal section rests on the bridge edge and the vertical section hangs outside the bridge edge; a plurality of bars protruding from the free end of the horizontal section; a plurality of profiles horizontally protruding from the free end of the horizontal section;

placing the plurality of vertical rods near an outmost edge of an outmost beam;

placing said beam on supports;

placing the free end of the horizontal section of the overhang structure over the outmost edge of the outmost beam;

setting the profiles in pairs, the plurality of profiles is set in pairs and placed close to each other, creating a space between them;

placing the corresponding vertical rod on the space created between each pair of profiles; and affixing each pair of profiles by using a retainer secured to the free end of the corresponding vertical rod.

4. The method according to claim 3, further comprising the step of placing a strip made of a malleable material on the beam before the structures.

* * * * *